United States Patent [19]

Rogers et al.

[11] Patent Number: 5,018,654

[45] Date of Patent: May 28, 1991

[54] HANDGUN HOLSTER WITH TRIGGER GUARD RESTRAINT

[75] Inventors: William H. Rogers; Norman E. Clifton, Jr., both of Jacksonville, Fla.

[73] Assignee: Safariland Ltd., Inc.

[21] Appl. No.: 364,323

[22] Filed: Jun. 12, 1989

[51] Int. Cl.[5] ..... F41C 33/02

[52] U.S. Cl. ..... 224/244; 224/911

[58] Field of Search ..... 224/244, 243, 911, 912, 224/253, 232, 242, 245; 24/555

[56] References Cited

U.S. PATENT DOCUMENTS

| | | | |
|---|---|---|---|
| 1,553,066 | 9/1925 | Burger | 224/242 |
| 4,186,690 | 2/1980 | Seiler | 24/602 |
| 4,277,007 | 7/1981 | Bianchi et al. | 224/244 |
| 4,408,375 | 10/1983 | Skobec | 24/625 |
| 4,846,384 | 7/1989 | Perry | 224/244 |

FOREIGN PATENT DOCUMENTS

| | | | |
|---|---|---|---|
| 8760 | of 1897 | United Kingdom | 224/232 |

*Primary Examiner*—Linda J. Sholl

*Attorney, Agent, or Firm*—Arthur G. Yeager

[57] ABSTRACT

Handgun holster having a restraining device inside the holster for retaining the handgun in the holster and inhibiting inadvertent removal from the holster, the restraining device comprising a rigid body with two parallel spaced flexible fins extending upward from the body, each fin having a pyramidal boss projecting outwardly toward the other fin and boss, the bosses being spaced apart from each other and the fins being adapted to be pushed apart by the trigger guard of a handgun bieng inserted into the holster and thereafter returning to the unflexed position with the bosses inside the trigger guard and being shaped to resist flexing outwardly when the handgun is pulled upwardly.

22 Claims, 5 Drawing Sheets

HANDGUN HOLSTER WITH TRIGGER GUARD RESTRAINT

BACKGROUND OF THE INVENTION

This invention relates to a handgun holster with a flexible restraint device for retaining the handgun in the holster and preventing it from removal not intended by the wearer.

Law enforcement officers, and particularly competitive shooters who have a need to carry a handgun normally do so in a holster, and it is important that the handgun be secure in the holster against falling out when the wearer is running or otherwise involved in activity, and against the possibility of withdrawal by someone other than the wearer. Various arrangements have been used to prevent inadvertent withdraWals from the holster, such as, cover flaps, restraining straps, spring mechanisms, custom molding of the holster to fit each gun, and the like., Typical of such holsters are those shown in Rodgers U.S. Pat. No. 4,694,980 and in U.S. Pat. No. 4,101.060 to Bianchi. A more recent development is described in Rogers U.S. Pat. No. 4,925,075 entitled HANDGUN HOLSTER WITH TRIGGER GUARD RESTRAINT in which a restraint device is affixed to the inside of the holster, the device having a spring biased catch for engaging the trigger guard of the holstered handgun. The present invention is an improvement over these prior art holsters.

It is an object of the present invention to provide an improved handgun holster. It is another object of this invention to provide an improved holster having a novel means for restraining the handgun from being withdrawn from the holster until the wearer intends to do so. Still other objects will become apparent from the more detailed description which follows.

BRIEF SUMMARY OF THE INVENTION

This invention relates to an improved handgun holster which is designed to permit withdrawal from the holster only after moving the handgun forward in the holster and then vertically upward and out of the holster. The holster contains a restraining device rigidly affixed inside of and at the back of the holster. The device has a rigid body generally rectangularly prismatic in shape and having two thin flexible fins extending upwardly from the body. Each fin has a pyramidal boss projecting outwardly toward the other fin and its boss such that the apexes of the two bosses are spaced apart from each other and are adapted to be pushed apart by the trigger guard of a handgun as it is inserted into the holster and to spring back when the handgun is fully inserted into the holster to come to rest inside the trigger guard. The bosses are shaped with gently sloping sides toward the top of the holster and toward the back of the holster, while the other sides toward the bottom and the front of the holster are generally perpendicular to the respective fin.

In a specific and preferred embodiment of the invention the holster also has a restraining strap means releasably fastenable over the butt of the handgun in the holster.

In a broad aspect of the invention the restraining device has a body and two opposing fins with one of the fins being the top having a portion movable outwardly and away from a corresponding portion of the other fin by a trigger guard of the handgun and flexing back after movement of the trigger guard to a confining space less than the width of the trigger guard of the handgun. The fins form a releasable lock on the trigger guard against any substantially vertical movement of the handgun after the handgun is fully seated in the holster, but permitting withdrawal of the handgun by a vertical upward movement only after movement of the handgun toward the front to cause the trigger guard to sufficiently clear and become unlocked from such portions of the fins.

Additionally the fins are adapted to bend convexly outwardly between each portion and the body when the trigger guard is pushed downwardly between each portion. The inner wall of the holster adjacent each portion of the fin includes a recess for permitting the fins to bend convexly outwardly. A pivot means is disposed within the holster near an underside of a muzzle of the handgun about which the handgun is pivotal forward to facilitate a release of the trigger guard from its locking engagement with the portions. The pivot means preferably is formed as part of and disposed adjacent a bottom of the body of the restraining device.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 2:
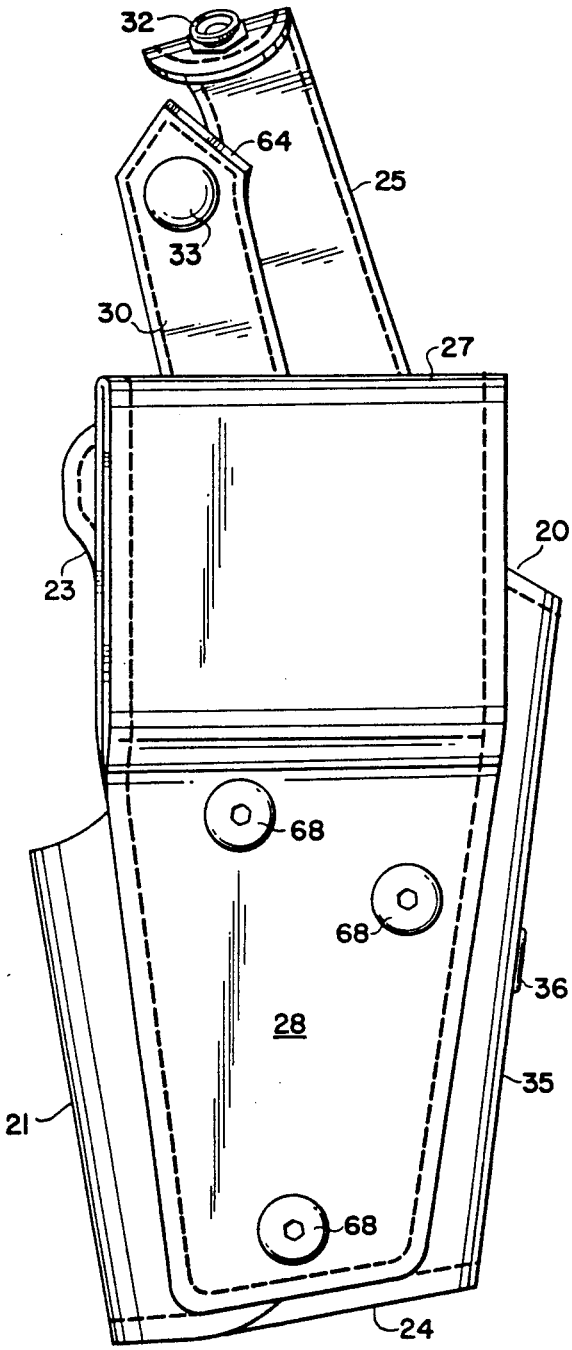
FIG. 2 is a left side elevational view of the holster of this invention.
Figure 1:
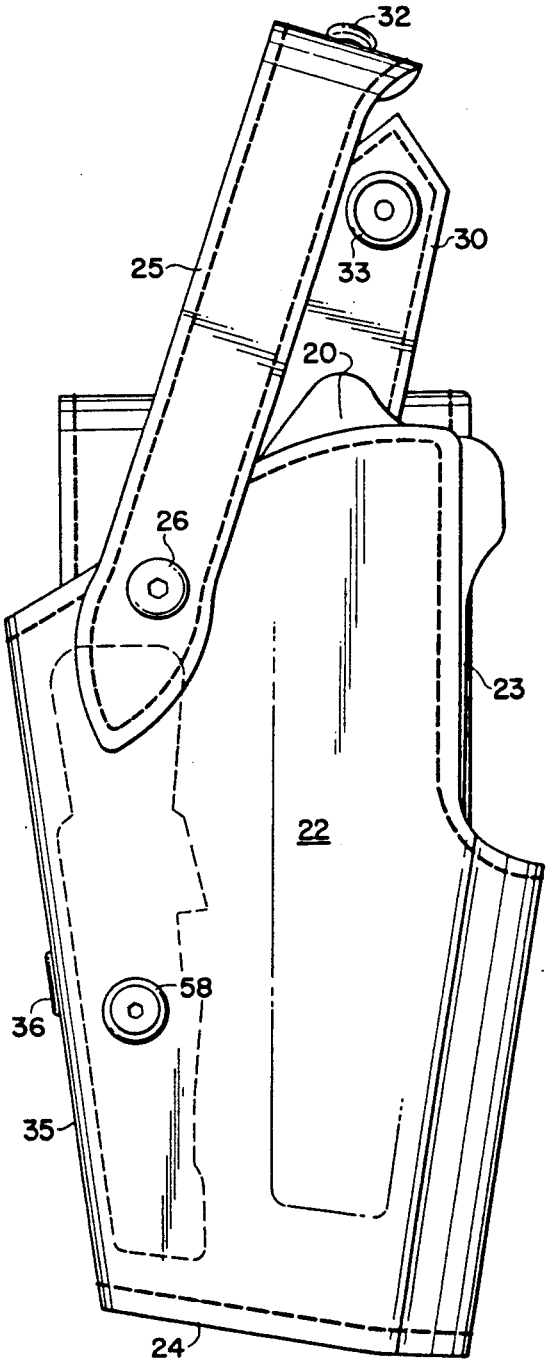
FIG. 1 is a right side elevational view of the holster of this invention.
Figure 3:
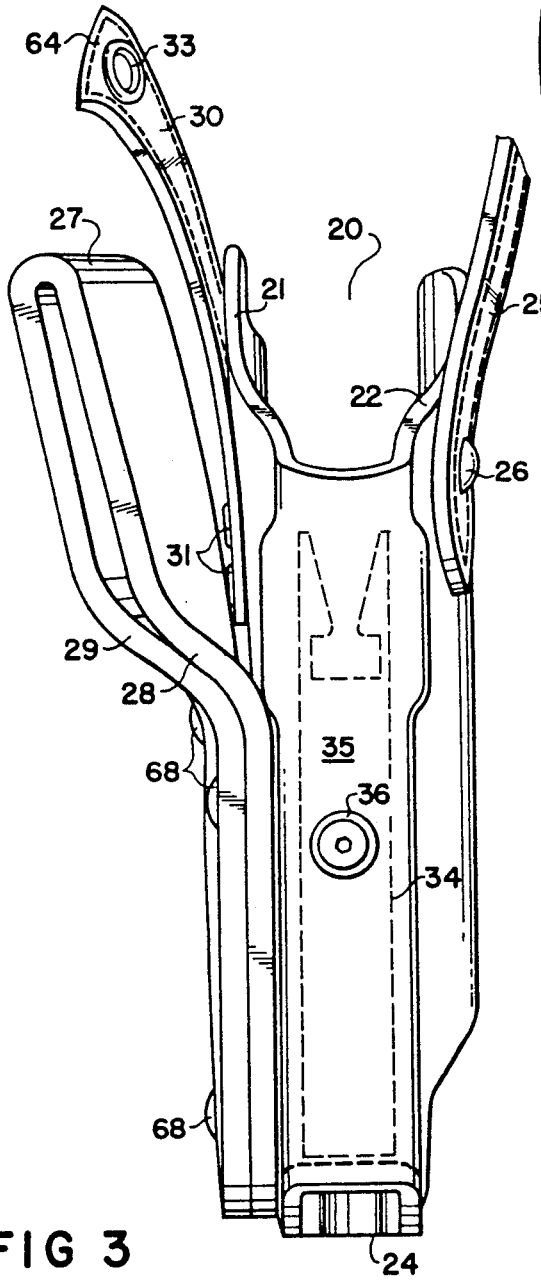
FIG. 3 is a rear elevational view of the holster of this invention.
Figure 4:
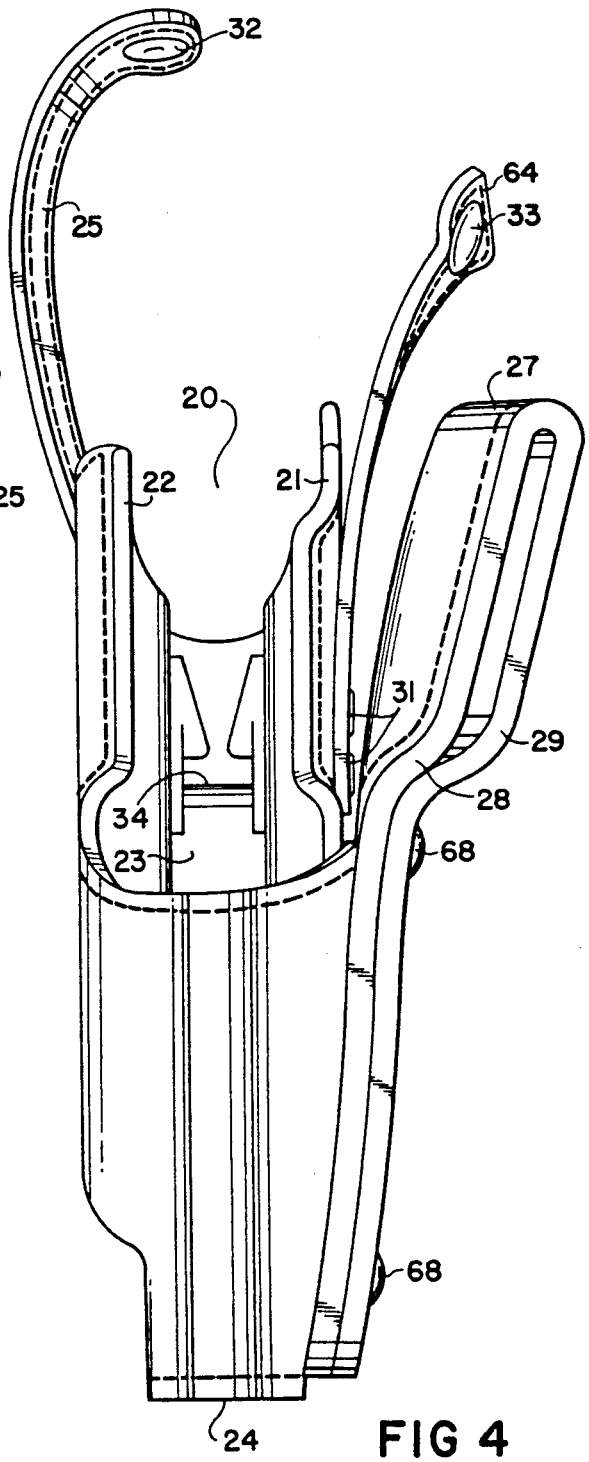
FIG. 4 is a front elevational view of the holster of this invention.
Figure 5:
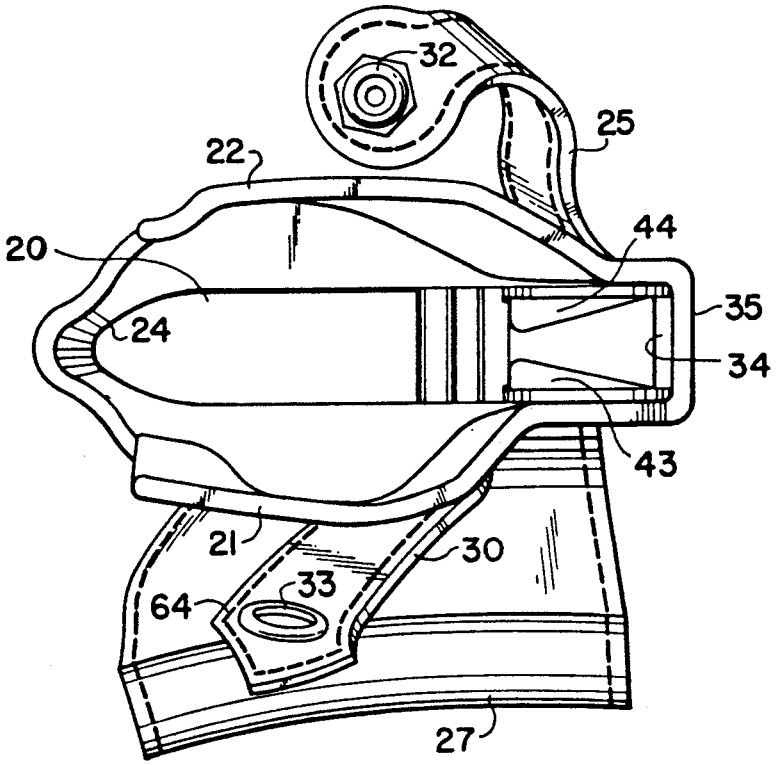
FIG. 5 is a top plan view of the holster of this invention, partly broken away with a semi-automatic pistol in the holster in the secure position.

The various features of this invention are best understood from the following description with reference to the accompanying drawings.

The holster, as seen in FIGS. 1–5, comprises an inner wall 21 and an outer wall 22, an open top 20, a bottom 24, enclosing a space in which a handgun is carried. These components as well as others in the following disclosure, are intended to describe directions and relative locations with respect to the wearer of the holster. Thus, inner wall 21 is closer to the body of the wearer than outer wall 22, and top 20 is vertically above bottom 24. A belt loop 27 is formed by an inside hip pad 28 and an outside member 29 held together by screw fasteners 68 at the lower end of the loop. The waist belt of the wearer can be threaded through loop 27. The inside of the hip pad resting against the wearer is smooth and preferably molded to fit the wearer's contours.

Figures 9, 10:
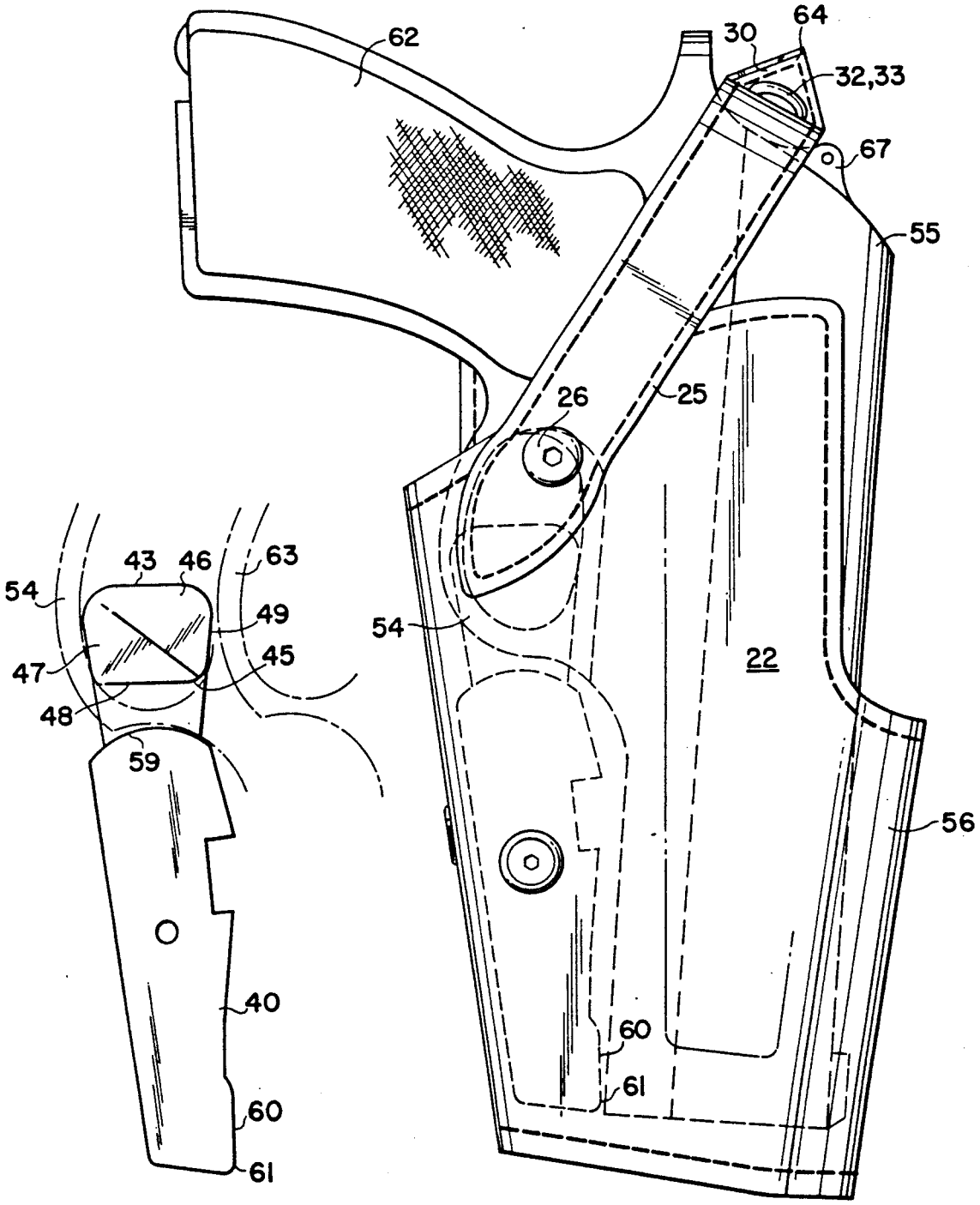
FIG. 9 is a schematic right side elevational view of the holster of this invention with a handgun inserted therein.
FIG. 10 is a schematic side elevational view of the restraining device and its relationship to the trigger guard of the handgun in FIG. 9.

The holster shown here is a front opening holster, which means that the handgun is withdrawn from the holster through a slotted front opening 23 extending from open top 20 to the bottom 24 of the holster. This particular design also employs a butt restraining strap 25 attached to outer wall 22 by a screw fastener 26 and a keeper strap 30 fastened to inner wall 21 by a screw fastener 31. The free end of strap 25 has the male portion 32 of a snap fastener which cooperates with the female portion 33 at the free end of strap 30. Straps 25 and 30 are joined together as seen in FIG. 9 to assist in keeping the handgun in the holster. To facilitate unsnapping of portions 32 and 33, a thumb tab 64 may be fashioned on the free end of keeper strap 30 which can be pressed by the thumb of the wearer of the holster.

The principal improvement of this invention which is believed to be novel and inventive is the restraining device 34 which is rigidly fastened inside the holster along its back or spine 35. A preferred method of fastening the device 34 to the holster back 35 is by screw 36 passing through holster back 35 and hole 38 to engagement with nut 39. Other fastening methods, e.g., riveting or cementing, are entirely suitable in some embodiments of this invention. Device 34 consists of a rigid body 40 and two flexible fin-like upward extensions, inside fin 41 and outside fin 42. Pyramidal boss 43 is attached to inside fin 41 and pyramidal boss 44 is attached to outside fin 42. Bosses 43 and 44 are mirror images of each other and are attached to fins 41 and 42, respectively, so as to be facing each other in a mirror image alignment.

Figure 6:
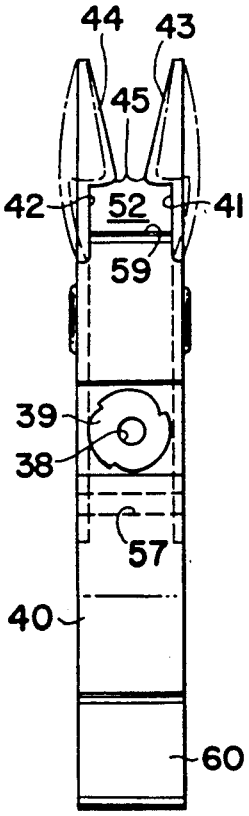
FIG. 6 is a rear elevational view of the handgun restraining device employed in the holsters of FIGS. 1–5.
Figure 11:
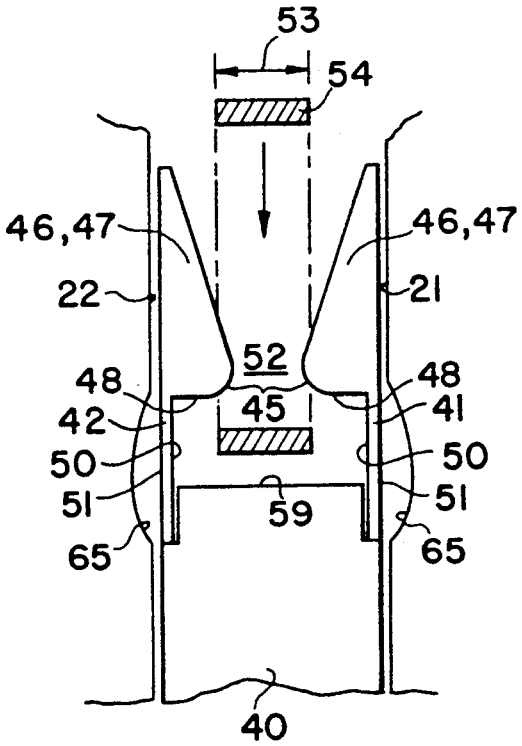
FIG. 11 is a schematic enlarged front elevational view similar to FIG. 6 showing how a trigger guard engages the device.
Figure 12:
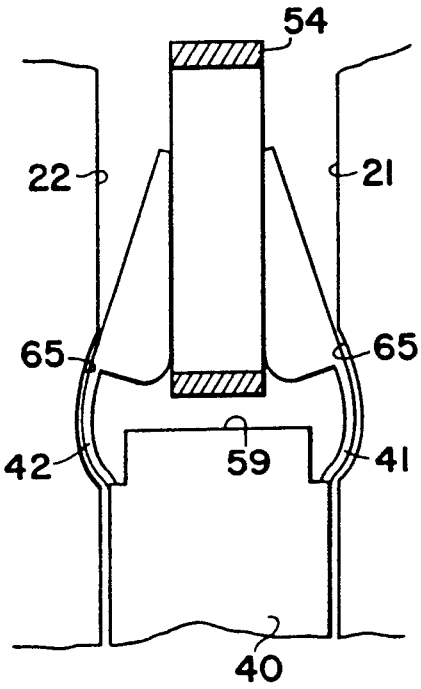
FIG. 12 is a view like FIG. 11 showing the effect of the trigger guard on the restraining device.

Each boss 43 or 44 is generally pyramidal in shape with four sides 46, 47, 48 and 49 meeting at an apex 45. Sides 46 and 47 slope very gradually from apex 45 to inside face 50 of fin 41 or 42. Sides 48 and 49 are sharply perpendicular to inside face 50 of fin 41 or 42. Side 46 faces open top 20 of the holster and side 47 faces back 35 of the holster. Side 48 faces bottom 24 of holster, and side 49 faces front 23 of holster. Apexes 45 of bosses 43 and 44 are spaced apart as at 52 less than the width 53 of trigger guard 54 of handgun 55 as best seen in FIGS. 11 and 12. Thus when handgun 55 is inserted into holster 56, the forward portion of the trigger guard 54 contacts sloping sides 46 of bosses 43 and 44 forcing apexes 45 farther and farther apart (as in FIG. 12) until trigger guard 54 passes below side 48 allowing fins 41 and 42 to spring back to the original unbent position (as in FIG. 11). In this position bosses 43 and 44 are inside trigger guard 54 and any upward movement of handgun 55 and trigger guard 54 will be stopped by contact with the wall of sides 48 of bosses 43 and 44. As may be seen in FIGS. 11 and 12 fins 41 and 42 tend to bow convexly outward when trigger guard 54 pushes outwardly against bosses 43 and 44. Generally a concave recess 65 will be molded into each wall 21 and 22 to receive that convex bowing of fins 41 and 42 as shown in FIGS. 6 and 12. When in an unflexed position fins 41 and 42 are made to fit snugly into back wall 35 of the holster.

Figure 7:
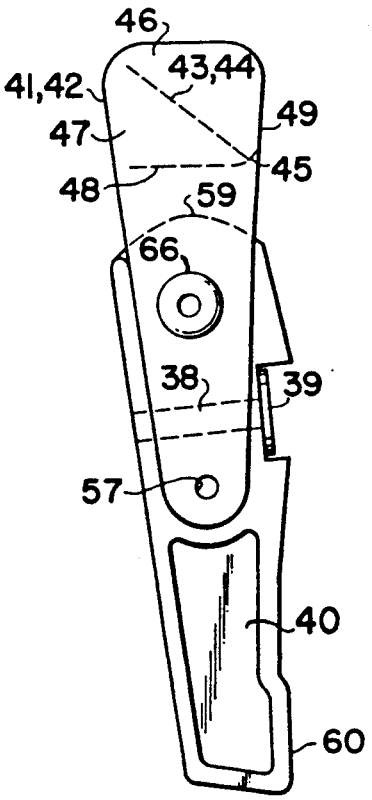
FIG. 7 is a side elevational view of the restraining device of FIG. 6.
Figure 8:
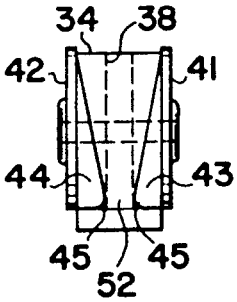
FIG. 8 is a top plan view of the restraining device of FIGS. 6 and 7.

The general construction of restraining device is seen best in FIGS. 6–8. A body 40 extended by fins 41 and 42 will extend generally from adjacent top 20 to adjacent bottom 24 of the holster. Fins 41 and 42 and their respective bosses 43 and 44 are custom fitted to each handgun so that bosses 43 and 44 will be operable to restrain the handgun in the holster, and, upon the appropriate movements, release the handgun from the holster. A rivet 66 or other fastener secures fins 41 and 42 to opposite sides of solid rigid body 40. Hole 38 and nut 39 are positioned to receive connecting screw 36 through back wall 35 of the holster. A lateral bore 57 passes through body 40 to receive a second fastening screw 58, if desired for the added security of holding device 34 rigidly in place. If device 34 is not held rigidly, there is a chance that bosses 43 and 44 might accidentally push against the trigger when the handgun is being inserted into or withdrawn from the holster, causing the gun to fire.

One safety feature of the restraining device of this invention is that the upper surface 59 of body 40 is positioned to contact the outside of trigger guard 54 (see FIG. 10) and prevent the handgun from being pushed too far into holster 56. This stop means is a protection against unintentional discharge of the handgun by reason of bosses 43 and 44 touching the trigger.

When the holstered handgun is to be withdrawn from holster 56 it must first be moved toward front 23 which causes trigger guard 54 to move up sloping side 47 until trigger guard 54 clears perpendicular wall 49 as at 63 in FIG. 10. This allows fins 41 and 42 to return to the original unflexed position with boss 43 outside of trigger guard 54, from which point the handgun may be withdrawn vertically upward to be removed from the holster. To facilitate the initial forward movement of the handgun a foot 60 of body 40 is positioned to be contacted by a portion 61 of the muzzle of handgun 55 and permits forward pressure on the butt 62 of handgun 55 to cause the handgun to pivot around foot 60 and allow trigger guard 54 to clear bosses 43 and 44.

It should be noted that while this description and its attached drawings refer to an open front holster, the restraining device 33 can clearly be employed with other types of holsters that are not open front designs The holster is preferably made of a molded plastic material as described and claimed in Rogers U.S. Pat. No. 4,340,437 which issued July 20, 1982. Restraining device 33 is preferably molded from plastic. Fins 41 and 42 may be strips of plastic, the same as or different from that of the rest of restraining device 33, or they may be of other material. The holster is equally suitable for a semi-automatic pistol or a revolver, and the holster may or may not be an open front design; it only being necessary to have enough room in the holster to permit the initial forward movement of the handgun before a vertical withdrawing movement.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. In a handgun holster adapted to permit withdrawal of a handgun from a cavity of a holster by a forward movement followed by a vertical upward movement of a handgun, said holster having with respect to a wearer an uninterrupted inner wall, an uninterrupted outer wall at least a partially closed an unopening front, a back, a top, a bottom, and a loop for suspending said holster from a belt worn by a wearer, the improvement which comprises a handgun restraining device entirely within said holster cavity and attached to the inside of said back of said holster and extending from adjacent said top to adjacent said bottom, said device including an elongated member having a body generally prismatic in shape and having two parallel flexible fins extending from said body to adjacent said top within said cavity along respective said walls, each said fin adjacent said top having a pyramidal boss projecting outwardly toward the other said fin and boss and terminating with a space between the respective apexes spaced apart from each other less than the width of a trigger guard of a handgun; each said boss having gently sloping sides from said top to said apex and from said back to said apex and having sides facing said front and said bottom that are substantially perpendicular to said fins; said boss being adapted to fit inside a trigger guard and to prevent removal of a handgun by a vertical upward movement until a handgun has been move toward said front to push said bosses apart sufficiently to clear a trigger guard.

2. The holster of claim 1 which additionally comprises a screw connection substantially midway between said top and said bottom rigidly affixing said device to said holster.

3. The holster of claim 1 which additionally comprises an open front extending from said top to at least midway between said top and said bottom with said front being closed from said bottom to at least midway between said bottom and said top.

4. The holster of claim 1 having a closed front with sufficient forward space to permit movement of a handgun forwardly adjacent its handle.

5. The holster of claim 1 which additionally includes restraining strap means affixed to said walls and adapted to be fastened around a grip of a handgun to prevent it from being inadvertently withdrawn.

6. The holster of claim 1 wherein said device includes a stop means to bear against an outside of said trigger guard to position a handgun properly for retention by said boss when a handgun is placed in said holster.

7. The holster of claim 1 wherein said cavity includes spaced recesses, said fins are adapted to bend covexly outwardly into respective said recesses between said boss and said body when a trigger guard is pushed downwardly between said bosses.

8. The holster of claim 1 wherein said device at the bottom thereof has a foot which is positioned closely spaced from a handgun near its muzzle to provide a ledge against which a handgun can be pivoted forward to facilitate a release of a trigger guard from said bosses.

9. The holster of claim 2 wherein said screw connection comprises a screw through the back of said holster engaged with screw threads in said device.

10. The holster of claim 1 wherein said bosses are mirror images of each other and said fins are independent of each other.

11. The holster of claim 10 wherein each said boss is shaped to fit snugly inside a trigger guard facing the other said boss.

12. The holster of claim 11 wherein each said boss has two contiguous gently sloping sides facing respectively toward said top of said holster and said back of said holster.

13. The holster of claim 6 wherein said stop means comprises a convexly rounded top of said body spaced closely away from said bosses.

14. A restraining clip for attachment within a cavity of a holster for a handgun adjacent its trigger guard permitting a trigger guard to be snapped thereunto and to be restrained from inadvertent withdrawal of a handgun from a holster by a vertical force or a forward force and only permitting withdrawal by a forward movement of a handgun followed by a vertical upward movement of a handgun, said clip comprising an elongated solid rectangular prismatic member having two vertical generally parallel side walls, a vertical back wall, a vertical front wall, and having a pair of flexible fins extending upwardly from each said side wall beyond said top wall; each said fin having an inside surface facing toward each other and an outside surface lying against respective said side wall; each said fin having on said inside surface a pyramidal boss projecting toward the other said fin with the apexes of said bosses being spaced apart less than the width of a trigger guard; said bosses having a gently sloping surface from said apex to said inside surface on the sides facing upward and toward said back wall and having a wall perpendicular to said inside surface on the sides of said boss facing said bottom wall and said front wall; said fins being flexible in directions toward and away from each other.

15. The clip of claim 14 in which said fins are made of a plastic material having sufficient flexibility to permit each said fin strip to flex outwardly and return to its normal position.

16. The clip of claim 14 which additionally comprises a threaded hole to receive a screw for attaching said clip rigidly to and within a cavity of a holster.

17. In a handgun holster adapted to permit withdrawal of a handgun from the holster by a forward movement followed by a vertical upward movement of a handgun, said holster having a cavity for a handgun and with respect to a wearer an uninterrupted inner wall, and uninterrupted outer wall, at least a partially closed and unopening front, a back, a top, a bottom, and a loop for suspending said holster from a belt worn by a wearer, the improvement which comprises a handgun restraining device entirely within said holster cavity attached to said back of said holster and extending from adjacent said top to adjacent said bottom, said device being an elongated member having a body generally prismatic in shape and having two parallel flexible fins extending from said body to adjacent said top within said cavity and along respective said walls, one said fin adjacent said to p having a portion movable outwardly and away from a corresponding portion of said other fin by a trigger guard of a handgun and flexing back after movement of a trigger guard to a confining space less than the width of a trigger guard of a handgun; said fins forming a releasable lock on a trigger guard against any substantially vertical movement of a handgun after a handgun is fully seated in said cavity of said holster, said fins permitting withdrawal of a handgun by a vertical upward movement only upon a prior movement of a handgun toward said front to cause a trigger guard to sufficiently clear and become unlocked and thence to be upwardly withdrawn.

18. The holster of claim 17 wherein said fins are adapted to bend onvexly outwardly between each said portion and said body when the trigger guard is pushed downwardly between each said portion.

19. The holster of claim 18 wherein said cavity of said holster adjacent each said portion of said fin includes a recess for permitting said fins to bend convexly outwardly.

20. The holster of claim 19 wherein surface facing each other each said fin having an inside and an outside surface lying against respective said side wall, each said portion including a pyramidal boss projecting toward the other said fin with the apexes of said bosses being spaced apart less than the width of a trigger guard; said bosses having a gently sloping surface from said apex to said inside surface on the sides facing upward and toward said back and having a wall perpendicular to said inside surface on the sides of said bosses facing said bottom and said front.

21. The holster of claim 20 which additionally comprises pivot means within said holster near an underside of a muzzle of the handgun about which a handgun is pivotal forward to facilitate a release of a trigger guard from its locking engagement with said bosses.

22. The holster of claim 21 wherein said pivot means is formed adjacent a bottom of said body.

* * * * *